US008500123B2

(12) United States Patent
Marcelis et al.

(10) Patent No.: US 8,500,123 B2
(45) Date of Patent: Aug. 6, 2013

(54) SHEET PROCESSING APPARATUS AND METHOD OF ADJUSTING A VERTICAL POSITION OF A SHEET INPUT OF A SHEET PROCESSING APPARATUS

(75) Inventors: Floris J. Marcelis, Venlo (NL); Antonius J. J. Van Gerven, Grubbenvorst (NL)

(73) Assignee: OCE Technologies B.V., Venlo (NL)

( * ) Notice: Subject to any disclaimer, the term of this patent is extended or adjusted under 35 U.S.C. 154(b) by 0 days.

(21) Appl. No.: 13/025,288

(22) Filed: Feb. 11, 2011

(65) Prior Publication Data

US 2011/0133387 A1 Jun. 9, 2011

Related U.S. Application Data

(63) Continuation of application No. PCT/EP2009/059652, filed on Jul. 27, 2009.

(30) Foreign Application Priority Data

Aug. 11, 2008 (EP) ..... 08162146

(51) Int. Cl.
*B65H 39/10* (2006.01)

(52) U.S. Cl.
USPC ..... 271/294; 271/292; 414/662

(58) Field of Classification Search
USPC ..... 248/188.4; 271/287, 292, 294; 414/609, 414/662
See application file for complete search history.

(56) References Cited

U.S. PATENT DOCUMENTS

| | | | | |
|---|---|---|---|---|
| 4,175,740 | A * | 11/1979 | Klenk | 493/435 |
| 4,403,771 | A * | 9/1983 | Kasahara et al. | 271/294 |
| 5,553,843 | A * | 9/1996 | Schenk | 271/226 |
| 6,131,870 | A * | 10/2000 | Tseng | 248/406.1 |
| 6,327,985 | B1 * | 12/2001 | Frenkler et al. | 108/147.19 |
| 6,435,048 | B1 * | 8/2002 | Zimmerman | 74/89.35 |
| 2009/0121100 | A1 * | 5/2009 | Waidelich et al. | 248/188.4 |

* cited by examiner

*Primary Examiner* — Patrick Cicchino
(74) *Attorney, Agent, or Firm* — Birch, Stewart, Kolasch & Birch, LLP

(57) ABSTRACT

A sheet processing apparatus and method of adjusting a vertical position of a sheet input of a sheet processing apparatus includes a support of the apparatus having first vertically elongated guiding members and second vertically elongated guiding members. The second guiding members are slideably arranged at the first guiding members. The first guiding members are connected to at least one base member, and the second guiding members are connected to a support frame. A vertical position of at least one of the second guide members is adjustable relative to a corresponding one of the first guide members in order to adjust a vertical position of the sheet input.

11 Claims, 3 Drawing Sheets

SHEET PROCESSING APPARATUS AND METHOD OF ADJUSTING A VERTICAL POSITION OF A SHEET INPUT OF A SHEET PROCESSING APPARATUS

CROSS-REFERENCE TO RELATED APPLICATIONS

This application is a Continuation of International Application No. PCT/EP2009/059652, filed on Jul. 27, 2009, and for which priority is claimed under 35 U.S.C. §120, and claims priority under 35 U.S.C. §119(a) to Application No. 08162146.8, filed in Europe on Aug. 11, 2008. The entirety of each of the above-identified applications is expressly incorporated herein by reference.

BACKGROUND OF THE INVENTION

1. Field of the Invention

The present invention relates to a sheet processing apparatus for operatively connecting to a sheet output of a printing apparatus, comprising: a sheet input configured to receive a printed recording sheet from a sheet output of a printing apparatus, at least one processing unit configured to process a sheet received at the sheet input, and at least one support configured to support the apparatus on a floor, the support comprising a support frame and at least one base member, the support frame supporting the sheet input and the processing unit.

The present invention further relates to a method of adjusting a vertical position of a sheet input of a sheet processing apparatus, wherein the sheet processing apparatus comprises at least one processing unit configured to process a sheet received at the sheet input and at least one support configured to support the apparatus on a floor, the support comprising a support frame configured to support the sheet input and the processing unit, the support further comprising at least one base member.

2. Background of the Invention

A sheet processing apparatus of the kind mentioned above is also known as a finisher. The sheet processing apparatus may be, e.g., a folder, a baler, a flat delivery rack, etc.

The sheet input of the sheet processing apparatus is arranged at the sheet output of a printing apparatus, for example a printer or a copier, and is operatively connected to establish an in-line configuration of the printing apparatus and the sheet processing apparatus. Sheets which are ejected from the sheet output of the printing apparatus are sequentially received at the sheet input of the sheet processing apparatus. However, the sheet may as well be a continuous web.

When a sheet processing apparatus is to be used with different printing apparatuses having different vertical positions of their sheet outputs, the vertical position of the sheet input of the sheet processing apparatus has to be adapted to the vertical position of the individual sheet output of a certain printing apparatus.

Folders are known that have a large input table, the slope of which can be adjusted in order to adapt the vertical position of the sheet input side of the input table. The size of the input table for wide format sheets may be approximately one square meter, for example. A disadvantage of an input table with adjustable slope is its large size, which leads to high costs and requires additional floor space. The input table is also of considerable weight.

From U.S. Pat. No. 5,553,843, an alignment module and transporter unit is known, on which an output sheet processing apparatus is mountable. A vertical alignment system has an operator rotatable wheel rotating a threaded rod which raises or lowers an elevating jack system, which in turn raises or lowers a support for the processing apparatus. Thereby, a sheet processing apparatus may be adapted to a sheet output position of a reproduction apparatus. However, the module requires a certain amount of free space below the sheet processing apparatus. Therefore, the height adjustment range is limited to height differences, which are at least as large as the minimum height of the module. Furthermore, the mounting of the sheet processing apparatus on the elevating jack system may bring about mechanical instabilities. Moreover, it is difficult to put a heavy apparatus on top of the alignment module.

When a sheet processing apparatus is shipped from its place of manufacture to a customer, it is desirable to minimize the transport volume. For reasons of transport safety, it is also desirable that the center of gravity of the apparatus is as low as possible. When, however, a support of the sheet processing apparatus is separated from the sheet processing apparatus in order to lower the center of gravity during shipping, the sheet processing apparatus has to be turned over in order to mount the support at the customers site. This is cumbersome and requires, especially in the case of a heavy apparatus, more than one person.

SUMMARY OF THE INVENTION

It is an object of the present invention to provide a sheet processing apparatus and a method of adjusting a vertical position of the sheet input of a sheet processing apparatus of the kind mentioned initially which allows an easy set-up and/or adjustment to a sheet output position of a printing apparatus.

The object of the invention is achieved by the sheet processing apparatus further comprising: first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame, and at least one height adjustment mechanism for adjusting a vertical position of at least one of the second vertically elongated guiding members relative to a corresponding one of the first vertically elongated guiding members, thereby adjusting a vertical position of the sheet input.

According to another aspect of the invention, the object is achieved by a method of adjusting a vertical position of a sheet input of a sheet processing apparatus of the kind mentioned initially, wherein the support further comprises first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame, the method comprising a step of adjusting a vertical position of at least one of the second vertically elongated guiding members relative to a corresponding one of the first vertically elongated guiding members, thereby adjusting the vertical position of the sheet input.

In particular, the vertical position of the sheet input may be adjusted relative to a sheet output of a printing apparatus.

The present invention allows adjustment of a vertical position of a sheet input having a fixed vertical position relative to the support frame supporting the processing unit. The sheet input may be operatively connected to the sheet output of the printing apparatus without an intermediate sheet transport.

Thus, together with the vertical position of the sheet input, a vertical position of the support frame, and, thus, of the processing unit is adjusted. More preferably, by adjusting a vertical position of at least one of the second vertically elongated guiding members relative to a corresponding one of the first vertically elongated guiding members, a vertical position of the sheet processing apparatus is adjusted relative to the at least one base member. That is, except for parts of the support, the whole sheet processing apparatus is raised or lowered.

The second vertically elongated guiding members are slideable relative to the first vertically elongated guiding members in a vertical direction. Thus, a high mechanical stability of the apparatus is achieved. Moreover, the vertical guiding members do not require much space and can be easily integrated in a conventional support having, for example, vertical legs. Because the height adjustment mechanism and the guide members are integrated into the sheet processing apparatus, a large adjustment range can be provided. Moreover, in a retracted configuration, an extremely low position of the support frame is achieved. This is advantageous when shipping the apparatus. There is no need to turn over the apparatus after shipping, and one person can adjust the height of the apparatus alone.

The vertically elongated guiding members are, for example, rods or rails formed of sheet metal having, for example, a base plate and two right angled wings, thus forming a slot. Preferably, the second vertically elongated members are guided in a slot of the first vertically elongated guiding members or vice versa. Preferably, the second vertically elongated guiding members are telescopically guided at the first vertically elongated guiding members.

Preferably, the guiding members are arranged at sides of the support frame. Thereby, they do not interfere with the structure of the processing unit.

The base members may, for example, be formed by two or more feet, which may be, e.g., integrally connected to the first vertically elongated guiding members.

A method for operatively connecting a sheet input of a sheet processing apparatus to a sheet output of a printing apparatus may comprise said method of adjusting a vertical position of the sheet output of the sheet processing apparatus relative to the sheet output of the printing apparatus, as described above.

Further useful details of the invention are indicated in the dependent claims.

Preferably, the height adjustment mechanism comprises: at least one threaded rod connected to one of said first vertically elongated guiding members and said second vertically elongated guiding members; and at least one nut engaged with the threaded rod and connected to the other one of said first vertically elongated guiding member and said second vertically elongated guiding members, wherein said first vertically elongated guiding member is slideable relative to said second vertically elongated guiding member by effecting a rotation of the threaded rod relative to the nut.

By effecting a rotation of the threaded rod relative to the nut, a movement of the nut along an axial direction of the rod relative to the rod, and, thus, a movement of the first support member relative to the second support member is effected.

Preferably, the threaded rod is rotatably connected to one of said first vertically elongated guiding members and said second vertically elongated guiding members. The threaded rod or spindle is a simple means for adjusting the height of the support frame. The threaded rod, engaged with the nut, functions as a reducing gear, so that a heavy apparatus can be lifted with comparatively low force. Preferably, the thread pitch is low enough to provide a self-locking function of the threaded rods, due to frictional forces, when in engagement with the nuts.

Preferably, the threaded rod is arranged in a vertical slot of the guiding members. Thereby, a compact structure of the height adjustment mechanism and the support is achieved, and no lateral forces are applied to the rod.

Preferably, the apparatus comprises no electrical drive means for effecting a rotation of the threaded rod relative to the nut. More preferably, the apparatus comprises no driving means for the height adjustment mechanism.

Preferably, the height adjustment mechanism comprises at least on torque transmission connector for engaging with a tool operated by an operator, said connector being adapted to receive a rotational force from said tool and being arranged to transmit said rotational force to at least one of said threaded rod and said nut in order to effect a rotation of the threaded rod relative to the nut. The connector may be suitable for a cordless electric screw driver. Thus, using a handy tool, a user or technician can easily adjust a vertical position of the sheet input when setting up the apparatus or when transferring the apparatus to a different printing apparatus.

Preferably, the height adjustment mechanism comprises at least two of said threaded rods and corresponding nuts, wherein at least two of the rods and/or at least two of the nuts are coupled. By coupling, for example, two threaded rods, a rotational force exerted on one of the threaded rods is transmitted to the other threaded rod, and their height adjustment movements are synchronized. Thus, the apparatus can be prevented from tilting.

Preferably, the height adjustment mechanism comprises a least one locking member for mechanically locking at least one of the second vertically elongated guiding members to a corresponding one of the first vertically elongated guiding members in a relative position of said first and second guide members, or in particular, more preferably, in one of several relative positions. The locking member comprises, for example, a locking pin or locking screw.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
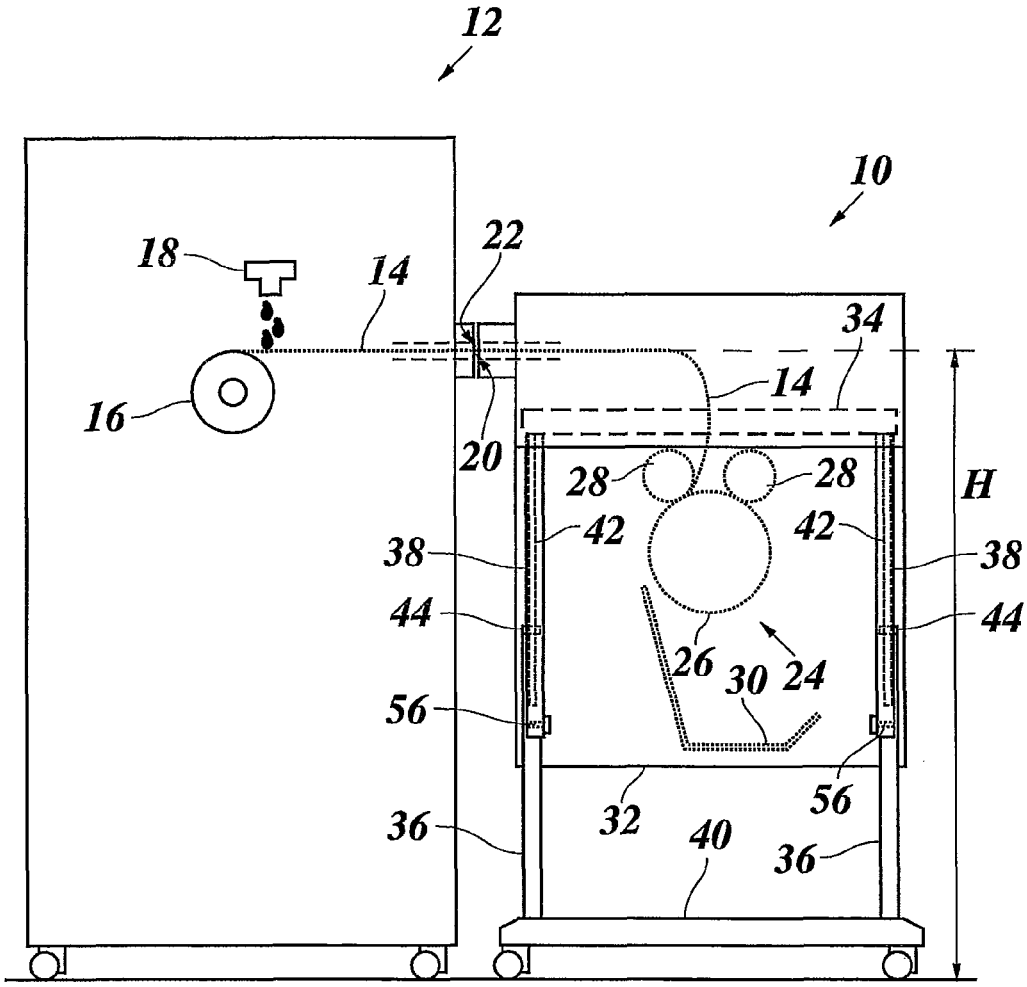
FIG. 1 is a schematic view of a sheet processing apparatus operatively connected to a printing apparatus.

The present invention will now be described with reference to the accompanying drawings, wherein the same reference numerals have been used to identify the same or similar elements throughout the several views.

FIG. 1 shows an in-line configuration of a sheet processing apparatus 10 and a printing apparatus 12.

In the printing apparatus 12, a recording sheet 14 is supplied, e.g., from a reel 16, and a printing engine, which is symbolically shown in FIG. 1 as an ink jet printhead 18, ejects drops of ink in an image-wise configuration onto the sheet 14. The printed sheet 14 is output through a sheet output 20 and fed, without an intermediate sheet transport, to a sheet input 22 of the sheet processing apparatus 10 arranged at a height H above a floor on which the sheet processing apparatus 10 and the printing apparatus 12 stand. Thus, the sheet processing apparatus 10 is operatively connected to the printing apparatus 12 in order to process the sheets ejected from the printing apparatus 12.

The sheet processing apparatus 10 is a folding apparatus and has a processing unit 24 which is symbolically shown in FIG. 1 as having a folding cylinder 26 and two press cylinders 28 for folding the sheet 14 according to a folding program. The folded sheet is ejected into a delivery tray 30. A feed unit (not shown) feeds the sheet 14 received at the sheet input 22 to the processing unit 24.

The processing unit 24, the feed unit and the sheet input 22, as well as a casing 32 of the sheet processing apparatus 10, are carried by a support frame 34 of a support. The support frame 34 is, in turn, supported by first and second vertically elongated guiding members 36, 38 of the support forming legs near the corners of the sheet processing apparatus 10. The first guiding members 36 are connected at their lower ends to base members 40 formed by horizontal rails. The base members form a base of the support and are provided with wheels. Upper ends of the second guiding members 38 are connected to rails of the support frame 34.

The second guiding members 38 are slideably arranged at the first guiding members, so that the guiding members 36, 38 form extendable legs.

The second guiding members 38 are each connected to a threaded rod 42, said rod 42 being engaged with a nut 44 which is connected to the corresponding first guiding member 36. As will be explained in detail below, the threaded rods 42 and nuts 44 form a height adjustment mechanism for the height H by controlling the extension of the legs.

Figure 2:
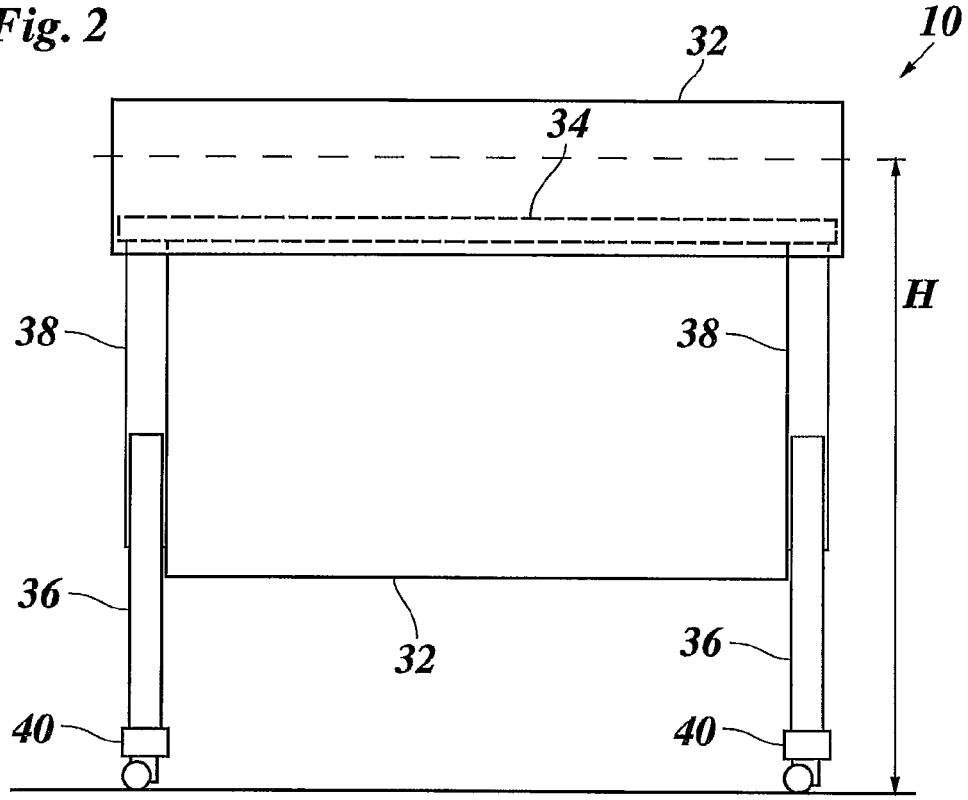
FIG. 2 is a schematic front view of the sheet processing apparatus in a configuration corresponding to FIG. 1.
Figure 3:
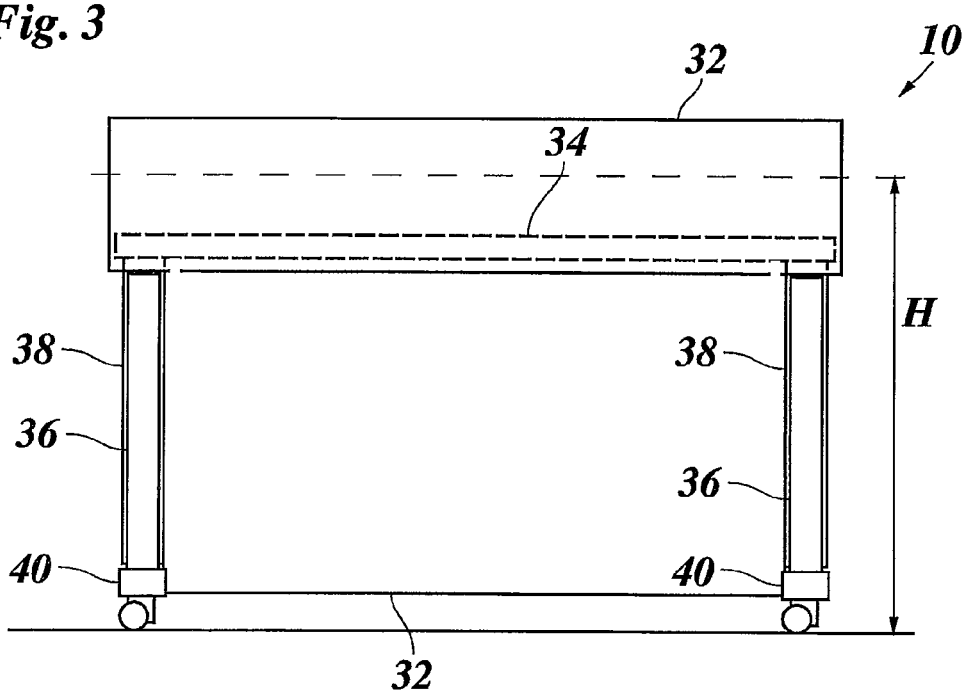
FIG. 3 is a schematic front view of the sheet processing apparatus in a configuration suitable for shipping.

FIGS. 2 and 3 are schematic front views of the sheet processing apparatus 10, seen from the right sight in FIG. 1. In FIG. 2, the guiding members 36, 38 are in an extended state corresponding to the height H of the sheet input 22 as shown in FIG. 1. In FIG. 3, the guiding members 36, 38 are in a non-extended state corresponding to a lowermost height H. This state is suitable for shipping the sheet processing apparatus 10, because the center of gravity as well as the total height is comparatively low.

By using the height adjustment mechanism as described exemplarily below with reference to FIGS. 4 and 5, the apparatus 10 can be adjusted to a position as shown in FIGS. 1 and 2.

Figure 4:
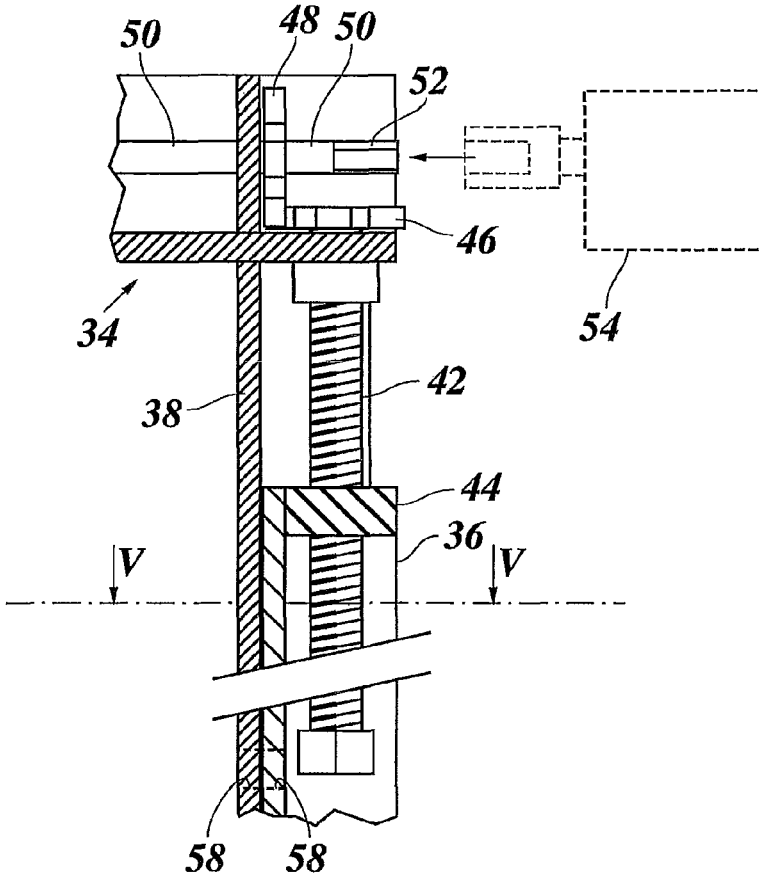
FIG. 4 is a schematic cross sectional view of a detail of a support and a height adjustment mechanism of the sheet processing apparatus.

FIG. 4 schematically shows details of guiding members 36, 38 corresponding to the right side of the sheet processing apparatus 10 in FIG. 1. FIG. 4 is a sectional view corresponding to the line in FIG. 5.

Figure 5:
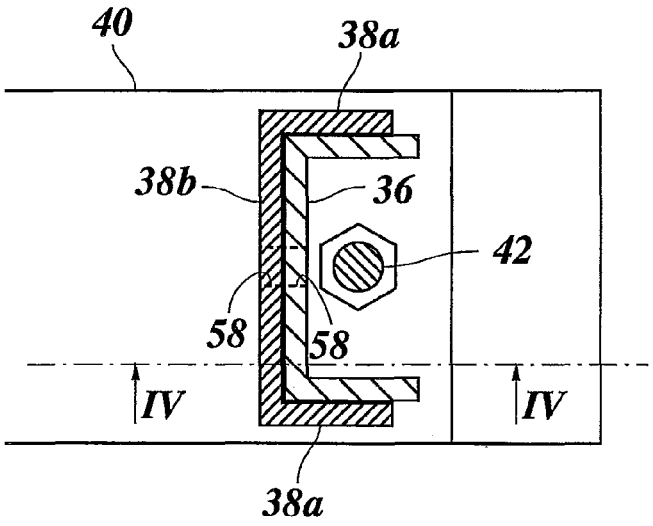
FIG. 5 is a schematic cross sectional view of guiding members of the support corresponding to the line V-V in FIG. 4.

In the cross-sectional view of FIG. 5, the guiding members 36, 38 have a U-shaped cross-section, the first guiding member 36 being an inner guiding member accommodated in the slot formed by the second guiding member 38. That is, the first guiding member 36 is guided between wings 38*a* of the second guiding member 38 and a base plate 38*b* connecting the wings 38*a*.

As is shown in FIG. 4, the second guiding member 38 is connected to a rail of the support frame 34. A vertically extending threaded rod 42 is rotatably connected to said rail, thereby being rotatably connected to the second guiding member 38. The vertical position of the threaded rods 42 is fixed relative to the second guiding member 38. At the top end of the threaded rod 42, a toothed wheel 46 is arranged. The toothed wheel 42 is engaged with another toothed wheel 48 arranged on a horizontal axle 50 extending to the opposite side of the support frame 34. There, a similar mechanism of toothed wheels connects the axle 50 to a corresponding threaded rod arranged at the guiding members 36, 38 shown in FIG. 1 on the left side of the sheet processing apparatus 10. Thereby, a transmission between both threaded rods 42 is provided in order to synchronize their rotational movements.

In FIG. 4, a torque transmission connector 52 is formed at the end of the axle 50 for engagement with an electric screw driver 54 schematically indicated in FIG. 4. Using this tool, rotation of the threaded rods 42 can be effected.

A nut 44 threadedly engaged with each threaded rod 42 is fixedly connected to the lower first guiding member 36 at the top end of the latter. Thus, a rotation of the threaded rod 42 effects a relative axial movement of the threaded rod 42 and the nut 44. Thereby, a vertical movement of the threaded rod 42 and the second guiding member 38 is effected. Thus, the height H of the sheet input 22 can be adjusted.

In the example described, the height H has to be adjusted separately for the guiding members 36, 38 on the left side and on the right side of FIGS. 2 and 3. However, all four threaded rods 42 may be connected by a transmission mechanism comprising e.g. a further axle, a transmission belt, or the like.

When the sheet processing apparatus 10 has been adjusted to the desired height H, locking pins 56 (FIG. 1) may be inserted into through holes 58 in the base plate 38*b* of the second guiding members 38 and the base plate of the first guiding members 36 at appropriate positions in order to lock the guiding members 36, 38 against further vertical relative movement. For example, through holes 58 may be arranged at regular intervals along the height of the first guiding members 36 and/or guiding members 38, as is schematically indicated in FIGS. 4 and 5.

The invention being thus described, it will be obvious that the same may be varied in many ways. For example, alternatively or additionally to the torque transmission connector 52, the height adjustment mechanism may comprise a handling member for manually providing a rotational force.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet processing apparatus for operatively connecting to a sheet output of a printing apparatus, comprising:

a sheet input configured to receive a printed recording sheet from a sheet output of a printing apparatus;

at least one processing unit configured to process a sheet received at the sheet input; and at least one support configured to support the apparatus on a floor, the at least one support comprising:

a support frame, the support frame supporting the sheet input and the at least one processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame; and at least one height adjustment mechanism configured to adjust a vertical position of at least one of the second vertically elongated guiding members relative to a corresponding one of the first vertically elongated guiding members, thereby adjusting a vertical position of the sheet input, wherein the support frame is located above the bottom of the at least one processing unit.

2. The apparatus according to claim 1, wherein the at least one height adjustment mechanism comprises:

at least one threaded rod connected to one of said first vertically elongated guiding members and said second vertically elongated guiding members; and at least one nut engaged with the threaded rod and connected to the other one of said first vertically elongated guiding members and said second vertically elongated guiding members, wherein said first vertically elongated guiding member is slideable relative to said second vertically elongated guiding member by effecting a rotation of the threaded rod relative to the nut.

3. The apparatus according to claim 2, wherein the at least one height adjustment mechanism further comprises at least one torque transmission connector configured to engage with a tool operated by an operator, said connector being adapted to receive a rotational force from the tool and being arranged to transmit said rotational force to at least one of said threaded rod and said nut in order to effect a rotation of the threaded rod relative to the nut.

4. The apparatus according to claim 2, wherein the at least one height adjustment mechanism further comprises at least two of said threaded rods and at least two corresponding nuts, and wherein at least two of the threaded rods and/or at least two of the nuts are coupled.

5. The apparatus according to claim 3, wherein the at least one height adjustment mechanism further comprises at least two of said threaded rods and at least two corresponding nuts, and wherein at least two of the threaded rods and/or at least two of the nuts are coupled.

6. The apparatus according to claim 1, wherein the apparatus is a folding apparatus.

7. A method of adjusting a vertical position of a sheet input of a sheet processing apparatus, wherein the sheet processing apparatus comprises at least one processing unit configured to process a sheet received at the sheet input and at least one support configured to support the apparatus on a floor, the at least one support comprising:

a support frame configured to support the sheet input and the processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame, said method comprising the step of:

adjusting a vertical position of at least one of the second vertically elongated guiding members relative to a corresponding one of the first vertically elongated guiding members, thereby adjusting the vertical position of the sheet input; and locating the support frame above the bottom of the at least one processing unit.

8. A sheet processing apparatus for operatively connecting to a sheet output of a printing apparatus, comprising:

a sheet input configured to receive a printed recording sheet from a sheet output of a printing apparatus;

at least one processing unit configured to process a sheet received at the sheet input; and at least one support configured to support the apparatus on a floor, the at least one support comprising:

a support frame, the support frame supporting the sheet input and the at least one processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame; and at least one height adjustment mechanism configured to adjust a vertical position of at least one of the second vertically elongated guiding members relative to a corresponding one of the first vertically elongated guiding members, thereby adjusting a vertical position of the sheet input, wherein the top of the second vertically elongated guiding members is located above the bottom of the at least one processing unit.

9. A sheet processing apparatus for operatively connecting to a sheet output of a printing apparatus, comprising:

a sheet input configured to receive a printed recording sheet from a sheet output of a printing apparatus;

at least one processing unit configured to process a sheet received at the sheet input; and at least one support configured to support the apparatus on a floor, the at least one support comprising:

a support frame, the support frame supporting the sheet input and the at least one processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame; and at least one height adjustment mechanism configured to adjust a vertical position of at least one of the second vertically elongated guiding members relative to a corresponding one of the first vertically elongated guiding members, thereby adjusting a vertical position of the sheet input, wherein the second vertically elongated guiding members are partially overlapped with the at least one processing unit from a lateral side view of the sheet processing apparatus.

10. A method of adjusting a vertical position of a sheet input of a sheet processing apparatus, wherein the sheet processing apparatus comprises at least one processing unit configured to process a sheet received at the sheet input and at least one support configured to support the apparatus on a floor, the at least one support comprising:

a support frame configured to support the sheet input and the processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame, said method comprising the step of:

adjusting a vertical position of at least one of the second vertically elongated guiding members relative to a corresponding one of the first vertically elongated guiding members, thereby adjusting the vertical position of the sheet input; and locating the top of the second vertically elongated guiding members above the bottom of the at least one processing unit.

11. A method of adjusting a vertical position of a sheet input of a sheet processing apparatus, wherein the sheet processing apparatus comprises at least one processing unit configured to process a sheet received at the sheet input and at least one support configured to support the apparatus on a floor, the at least one support comprising:

a support frame configured to support the sheet input and the processing unit;

at least one base member;

first vertically elongated guiding members and second vertically elongated guiding members, the second vertically elongated guiding members being slideably arranged at the first vertically elongated guiding members, the first vertically elongated guiding members being connected to the at least one base member, and the second vertically elongated guiding members being connected to the support frame, said method comprising the step of:

adjusting a vertical position of at least one of the second vertically elongated guiding members relative to a corresponding one of the first vertically elongated guiding members, thereby adjusting the vertical position of the sheet input; and locating the second vertically elongated guiding members to be partially overlapped with the at least one processing unit from a lateral side view of the sheet processing apparatus.

* * * * *